US012631194B2

(12) United States Patent
Kollipara et al.

(10) Patent No.: US 12,631,194 B2
(45) Date of Patent: May 19, 2026

(54) EXHAUST FAN

(71) Applicant: Greenheck Fan Corporation, Schofield, WI (US)

(72) Inventors: Vijaya K. Kollipara, Weston, MI (US); Tim Twohig, Schofield, WI (US); Shamus Doran, Kronewetter, WI (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 18/592,901

(22) Filed: Mar. 1, 2024

(65) Prior Publication Data

US 2024/0295226 A1 Sep. 5, 2024

Related U.S. Application Data

(60) Provisional application No. 63/488,445, filed on Mar. 3, 2023.

(51) Int. Cl.
*F04D 29/42* (2006.01)
*F04D 29/40* (2006.01)

(52) U.S. Cl.
CPC ..... *F04D 29/4226* (2013.01); *F04D 29/403* (2013.01)

(58) Field of Classification Search
None
See application file for complete search history.

(56) References Cited

U.S. PATENT DOCUMENTS

| | | | | |
|---|---|---|---|---|
| 3,695,775 | A | 10/1972 | Zenker | |
| 3,733,843 | A * | 5/1973 | MacLeod | F24F 1/022 62/262 |
| 3,809,503 | A | 5/1974 | Schlicker et al. | |
| 4,261,255 | A * | 4/1981 | Anderson | F24F 7/007 415/126 |
| 9,689,581 | B2 * | 6/2017 | Zakula | F24F 7/007 |
| 9,945,580 | B2 * | 4/2018 | Penlesky | F24F 13/32 |
| 2004/0072538 | A1 * | 4/2004 | Kennedy | F04D 29/023 454/342 |
| 2004/0119374 | A1 * | 6/2004 | Carl, Jr. | H10D 84/988 310/211 |

FOREIGN PATENT DOCUMENTS

| | | | | |
|---|---|---|---|---|
| CN | 107795508 A | * | 3/2018 | F04D 25/12 |
| CN | 109931640 B | | 1/2024 | |
| CN | 220366461 U | | 1/2024 | |
| CN | 220366474 U | | 1/2024 | |

* cited by examiner

*Primary Examiner* — Courtney D Heinle
*Assistant Examiner* — Danielle M. Christensen
(74) *Attorney, Agent, or Firm* — Merchant & Gould P.C.

(57) ABSTRACT

An exhaust fan assembly can include an outer housing, a fan housing mounted to the outer housing, a fan wheel and an electric motor operably coupled to the fan wheel, the fan wheel and electric motor being mounted within the fan housing, wherein the fan housing defines an open inlet side for accepting airflow in a direction generally parallel to a rotational axis of the fan wheel and an outlet for discharging airflow in a direction generally perpendicular to the rotational axis. In some examples, the fan assembly is provided with a volute wall structure to guide airflow from the inlet to the outlet.

18 Claims, 14 Drawing Sheets

EXHAUST FAN

RELATED APPLICATION

This application claims priority to U.S. Provisional Application Ser. No. 63/488,445, filed on Mar. 3, 2023, the entirety of which is incorporated by reference herein.

TECHNICAL FIELD

Embodiments are in the field of air movement devices, for example exhaust fans, including system design, manufacturing methods, and delivery methods.

BACKGROUND

Exhaust fans are frequently used in commercial, institutional, residential, and industrial applications to remove air from a space. In some applications, relatively small exhaust fans are configured to be mounted in a wall or ceiling wherein the height, width, and depth can be constrained by the studs or other structure of the wall or ceiling. In such circumstances, the fan and motor are typically concealed by a grille. To be commercially competitive, typical fans of this type must have a generally low cost which can result in a generally low efficiency rating. Improvements are desired.

SUMMARY

Air movement devices and methods for their manufacture and delivery are disclosed. In one example, an exhaust fan assembly can include a housing assembly including a perimeter wall structure defining an interior region and an air outlet opening; a first sidewall mounted to a first side of the perimeter wall structure and defining an air inlet opening; and a second sidewall mounted to a second side of the perimeter wall structure; a volute wall structure extending between the first and second sidewalls and dividing the interior region into a first interior region and a second interior region, the first interior region being in fluid communication with the air inlet opening and the air outlet opening; a fan wheel disposed within the first interior region; and an electric motor disposed within the first interior region and operably coupled to the fan wheel, the electric motor being mounted to the second sidewall and/or to the volute wall. In some examples, the fan wheel includes a plurality of fan blades defining an inner inlet region. In some examples, a stator and rotor of the electric motor are disposed entirely outside of the inner inlet region. In some examples, the electric motor is located entirely between the fan wheel and the second sidewall. In some examples, the electric motor is an axial flux type motor. In some examples, the fan wheel is a centrifugal fan wheel.

In some examples, the volute wall structure is mounted to one or more of the perimeter wall structure, the first sidewall, and the second sidewall. In some examples, the volute wall structure defines a tongue portion adjacent the outlet opening in the perimeter wall structure. In some examples, the volute wall structure defines a curved portion extending to the tongue portion. In some examples, the curved portion is a continuously curved portion. In some examples, the curved portion has a varying radius of curvature. In some examples, the volute wall structure defines an extension portion extending between the curved portion and the outlet opening on a side opposite the tongue portion. In some examples, the perimeter wall structure has a height H1 of no greater than 7⅜ inches, and in some examples a height no greater than 5⅜ inches, a height no greater than 4 inches, and in some further examples, a height of no greater than 2⅜ inches. In some examples, a grill is mounted to the housing.

In one example, an exhaust fan assembly can include a housing assembly defining an interior region; a fan wheel disposed within the interior region, the fan wheel including a plurality of fan blades defining an inner inlet region; and an electric motor disposed within the interior region and operably coupled to the fan wheel, the electric motor being mounted to a second sidewall and/or to a volute wall such that a stator and rotor of the electric motor are located entirely outside of the inner inlet region. In some examples, the housing assembly includes a perimeter wall structure defining the interior region and an air outlet opening; a first sidewall mounted to a first side of the perimeter wall structure and defining an air inlet opening; and a second sidewall mounted to a second side of the perimeter wall structure. In some examples, the exhaust fan assembly includes a volute wall structure extending between first and second sidewalls and dividing the interior region into a first interior region and a second interior region, the first interior region being in fluid communication with the air inlet opening and the air outlet opening, wherein the fan wheel and electric motor are located within the first interior region. In some examples, the electric motor is located entirely between the fan wheel and the second sidewall. In some examples, the electric motor is an axial flux type motor. In some examples, the electric motor has a printed circuit board (PCB) stator. In some examples, the fan wheel is a centrifugal fan wheel. In some examples, the perimeter wall structure has a height of no greater than 7⅜ inches and in some examples, no greater than 4 inches. In some examples, a grill is mounted to the housing.

An exhaust fan assembly can include a housing assembly including: a perimeter wall structure defining an interior region and an air outlet opening; a first sidewall mounted to a first side of the perimeter wall structure and defining an air inlet opening; and a second sidewall mounted to a second side of the perimeter wall structure; a volute wall structure extending between the first and second sidewalls and dividing the interior region into a first interior region and a second interior region, the first interior region being in fluid communication with the air inlet opening and the air outlet opening; an electrical junction box disposed within the second interior region; a fan wheel disposed within the first interior region, the fan wheel having a plurality of fan blades rotatable about a longitudinal axis; and an electric motor disposed within the first interior region and operably coupled to the fan wheel, wherein a stator and a rotor of the electric motor are axially separated from the plurality of fan blades in a direction along the longitudinal axis.

In some examples, the volute wall structure is formed from a polymeric material and the housing assembly is formed from a metal material.

In some examples, a length of a portion of the electric motor including the stator and the rotor is less than half of a length of the plurality of fan blades.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The foregoing summary, as well as the following detailed description, will be better understood when read in conjunction with the appended drawings. For the purpose of illustration only, there is shown in the drawings certain embodiments. It's understood, however, that the inventive concepts disclosed herein are not limited to the precise arrangements and instrumentalities shown in the figures.

DETAILED DESCRIPTION

Figure 1:
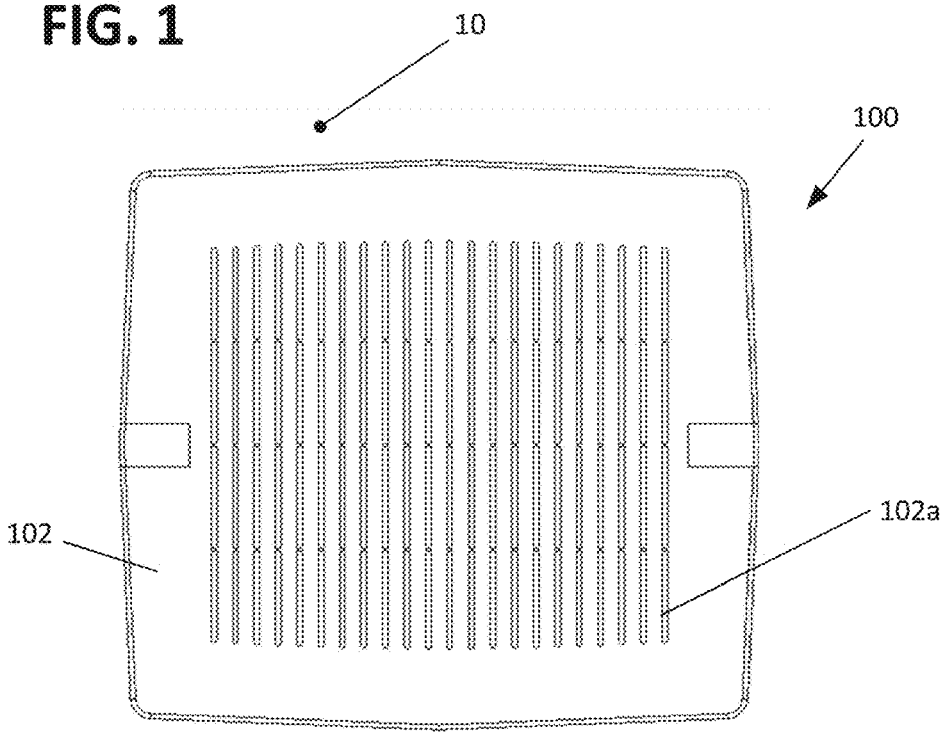
FIG. 1 is a schematic front view of an exhaust fan assembly having features in accordance with the present invention.
Figure 2:
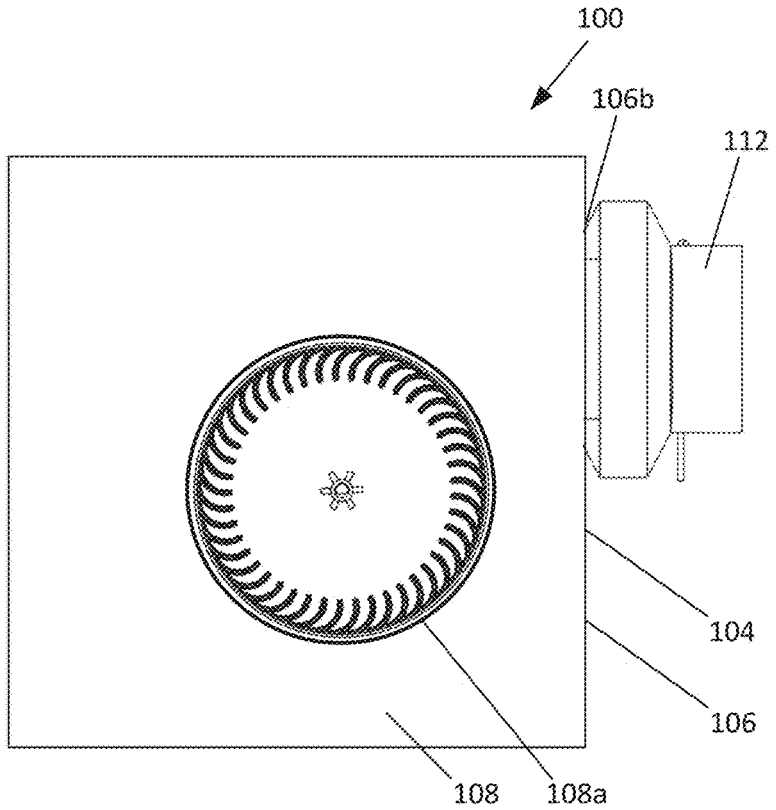
FIG. 2 is a schematic front view of the exhaust fan assembly shown in FIG. 1, with a grill removed.
Figure 3:
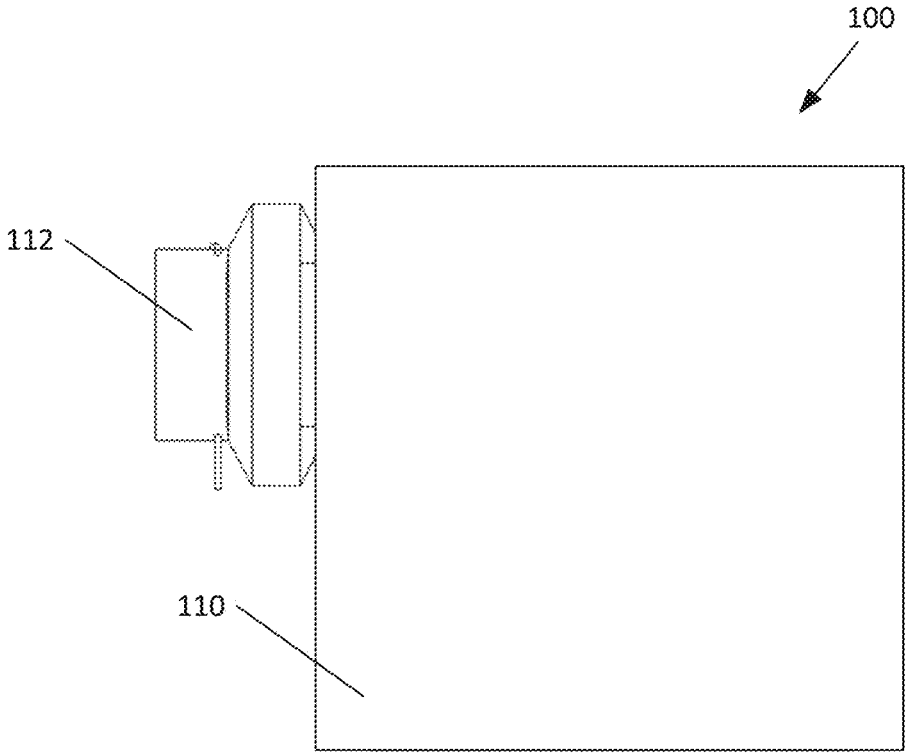
FIG. 3 is a schematic rear view of the exhaust fan assembly shown in FIG. 1.
Figure 4:
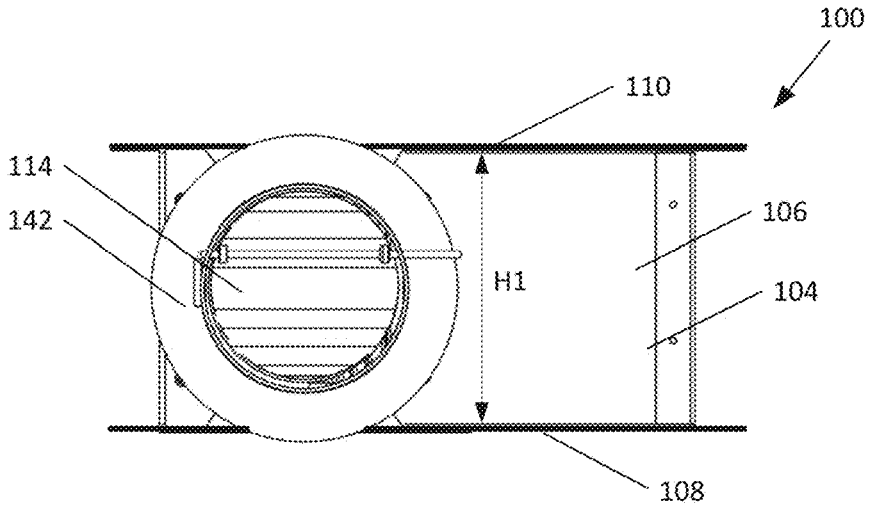
FIG. 4 is a schematic first side view of the exhaust fan assembly shown in FIG. 1.
Figure 5:
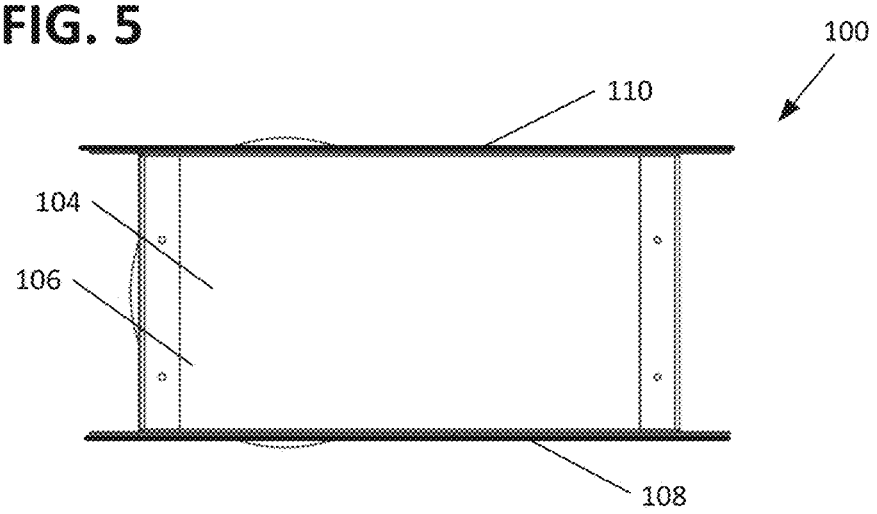
FIG. 5 is a schematic second side view of the exhaust fan assembly shown in FIG. 1.
Figure 6:
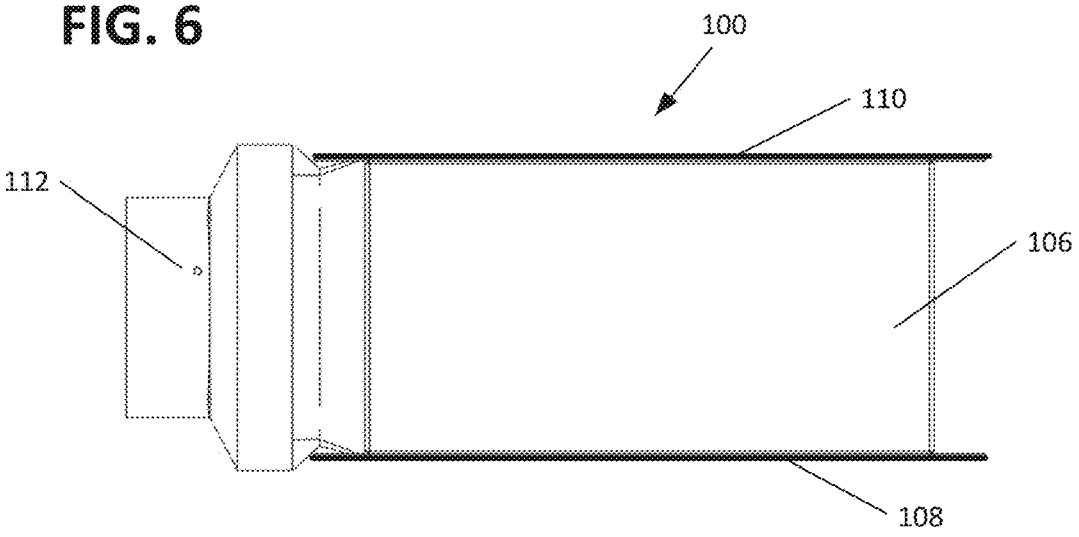
FIG. 6 is a schematic third side view of the exhaust fan assembly shown in FIG. 1.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Referring to FIGS. 1 to 11, an exhaust fan 100 is disclosed. In FIG. 1, the exhaust fan 100 is schematically shown as being mounted in a wall or ceiling 10 and arranged such that a grill 102 of the exhaust fan 100 is the only viewable part of the exhaust fan 100 from within a space from which the exhaust fan 100 is exhausting air. The grill 102 includes a plurality of slots 102*a* which allow air to flow upwards through the exhaust fan 100. As presented, the exhaust fan 100 is further provided with a housing assembly 104, an outlet collar 112, an electrical junction box assembly (not shown), and a fan-motor assembly 120, each of which is discussed in further detail below.

As shown, the exhaust fan 100 includes a housing assembly 104 for retaining the components of the exhaust fan 100 and that interconnects with the grill 102, for example via spring clips. In one aspect, the housing assembly 104 includes a perimeter wall structure 106 with four sidewalls defining an interior region 106*a* and an air outlet opening 106*b*. The perimeter wall structure 106 defines a generally rectangular shape and can form, as in the example shown, a generally square shape. Other perimeter shapes are possible. In one aspect, an outlet collar assembly 112 is provided at the air outlet opening 106*b*. In the example shown, a backdraft assembly 114 is provided in the outlet collar assembly 112. As shown at FIGS. 2 and 4-8, the housing assembly 104 further includes a first sidewall 108 mounted to a first side of the perimeter wall structure 106 and defining an air inlet opening 108*a*. As shown at FIGS. 3-6, the housing assembly 104 further includes a second sidewall 110 mounted to a second side of the perimeter wall structure 106. In the example shown, the perimeter wall structure 106 and the first and second sidewalls 108, 110 are formed from a metal material, such a steel sheet metal. Other materials are possible.

Figure 7:
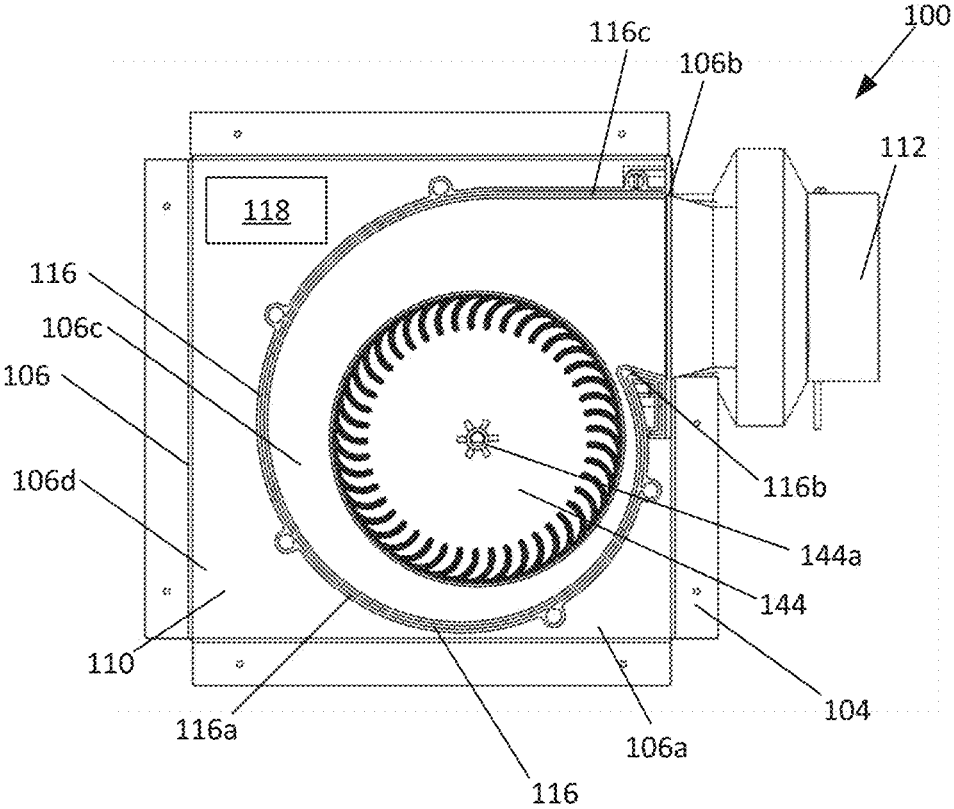
FIG. 7 is a schematic front view of the exhaust fan assembly shown in FIG. 1, with a grill and a front panel removed.
Figure 8:
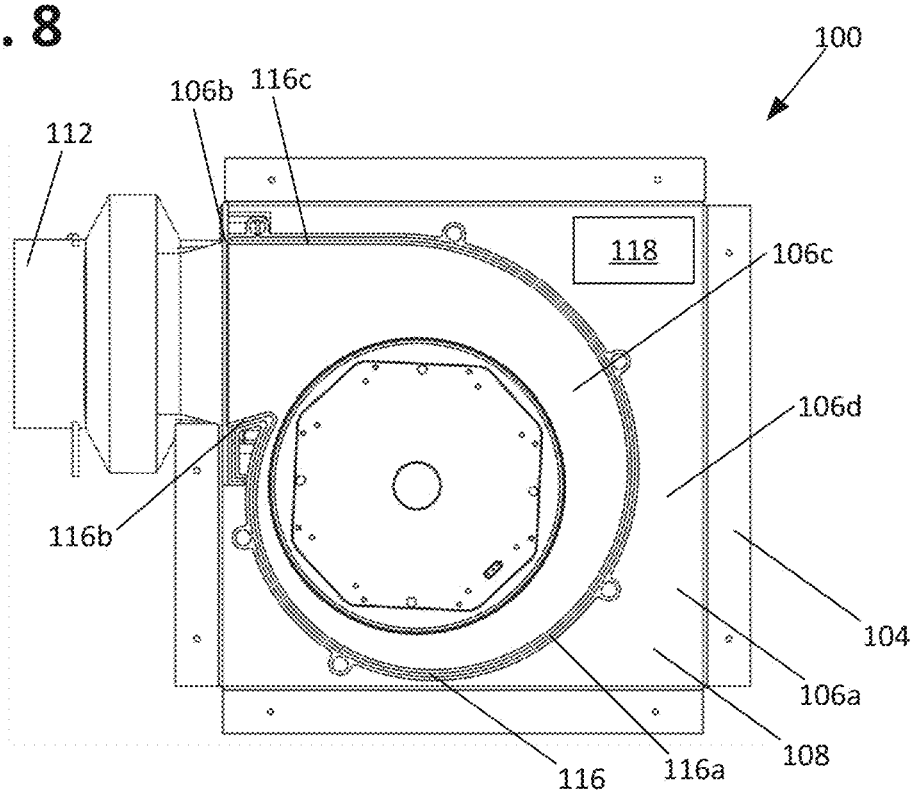
FIG. 8 is a schematic rear view of the exhaust fan assembly shown in FIG. 1, with a rear panel removed.
Figure 9:
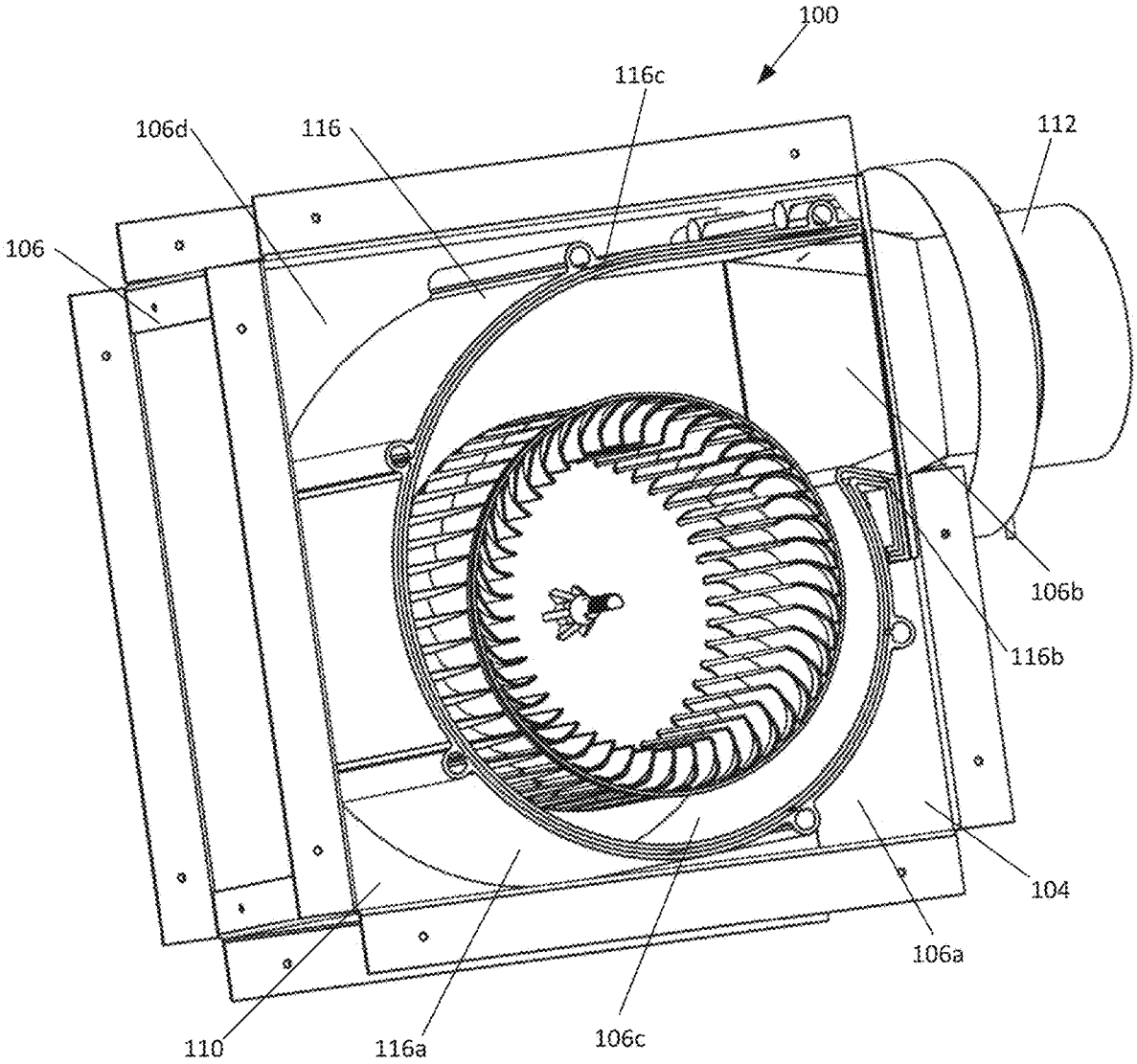
FIG. 9 is a schematic front perspective view of the exhaust fan assembly shown in FIG. 1, with a grill and a front panel removed.
Figure 10:
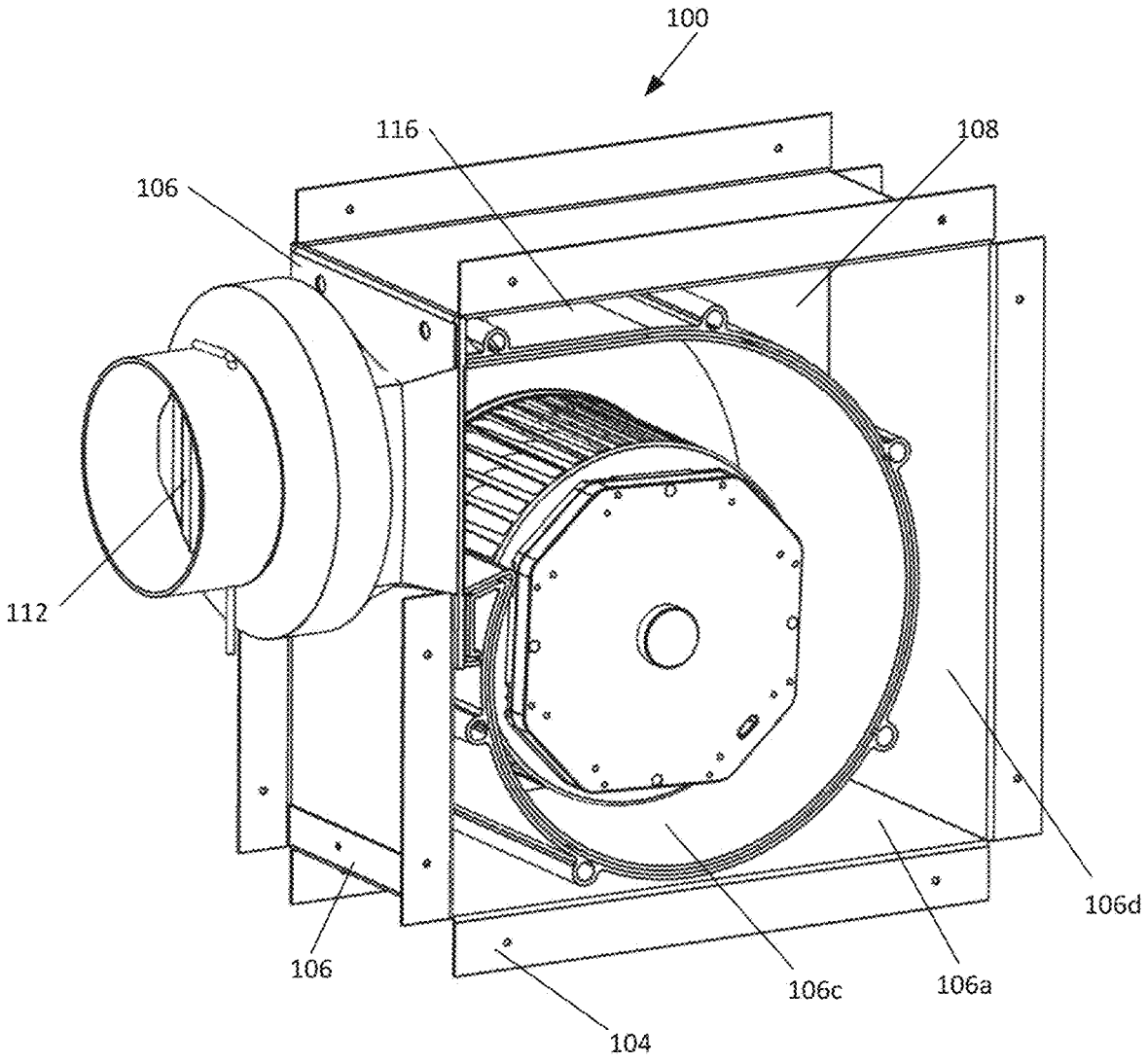
FIG. 10 is a schematic rear perspective view of the exhaust fan assembly shown in FIG. 1, with a rear panel removed.
Figure 11:
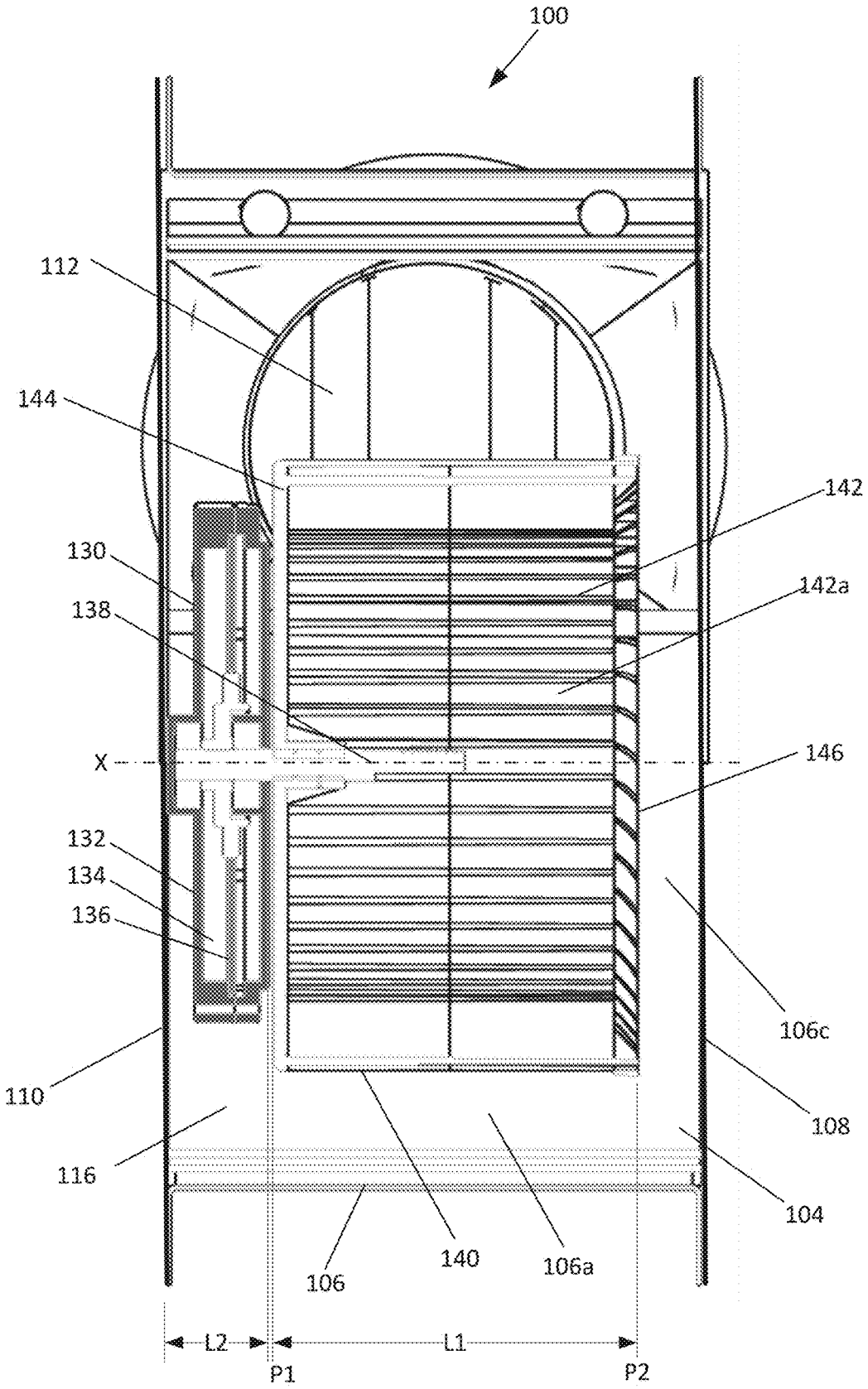
FIG. 11 is a schematic cross-sectional view of the exhaust fan assembly shown in FIG. 1.

Referring to FIGS. 6-10, the exhaust fan 100 is further shown as including a volute wall structure 116. In one aspect, the volute wall structure 116 has a width equaling a height of the perimeter wall structure 106 and extends between the first and second sidewalls 108, 110. In one aspect, the volute wall structure 116 divides the interior region 106*a* into a first interior region 106*c* and a second interior region 106*d*. In one aspect, the first interior region 106*c* is in fluid communication with both the air inlet opening 108*a* and the air outlet opening 106*b*. As such, the volute wall structure 116 defines an airflow path between the air inlet opening 108*a* and the air outlet opening 106*b*. In one aspect, the second interior region 106*d* is isolated from the air inlet opening 108*a* and the air outlet opening 106*b*. In one example, and as schematically shown at FIGS. 7 and 8, an electrical junction box assembly 118 for providing electrical power to the exhaust fan 100 can be provided in the second interior region 106*d*. In one characterization, the first interior region 106*c* can be referred to as an airflow region 106*c* while the second interior region 106*d* can be referred to as a non-airflow region 106*d*.

Figure 12:
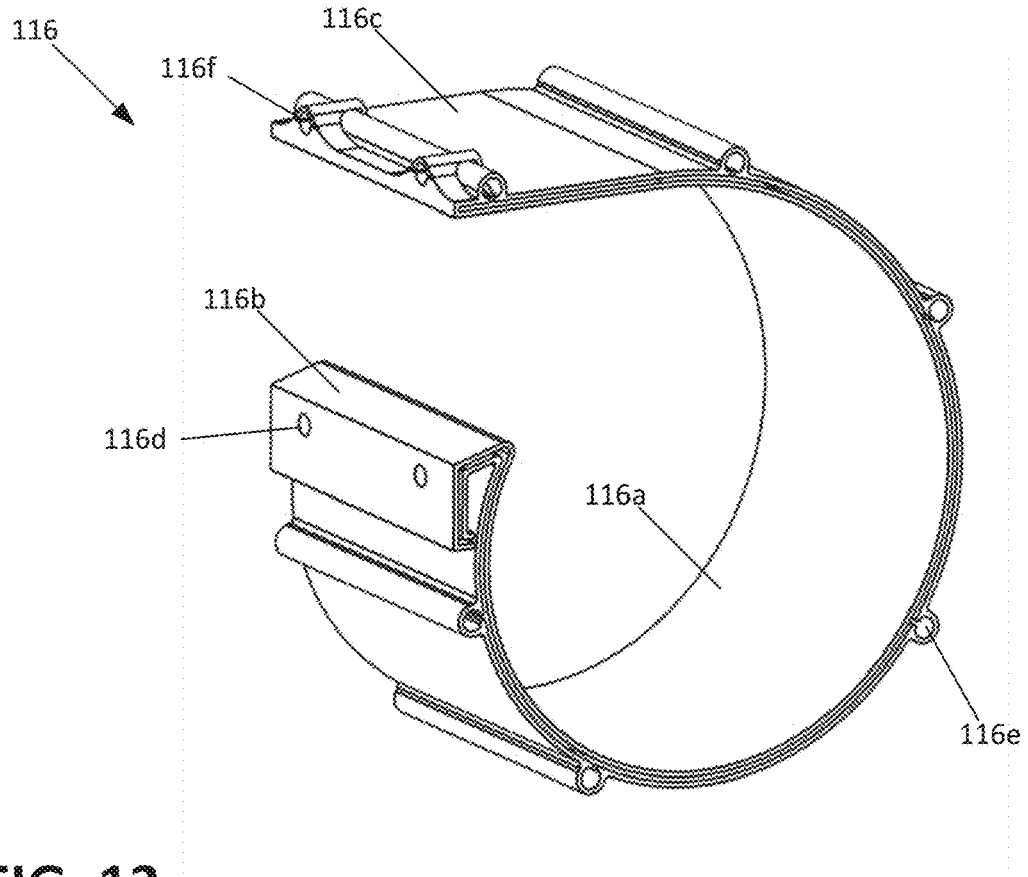
FIG. 12 is a schematic perspective view of a volute wall of the exhaust fan assembly shown in FIG. 1.
Figure 13:
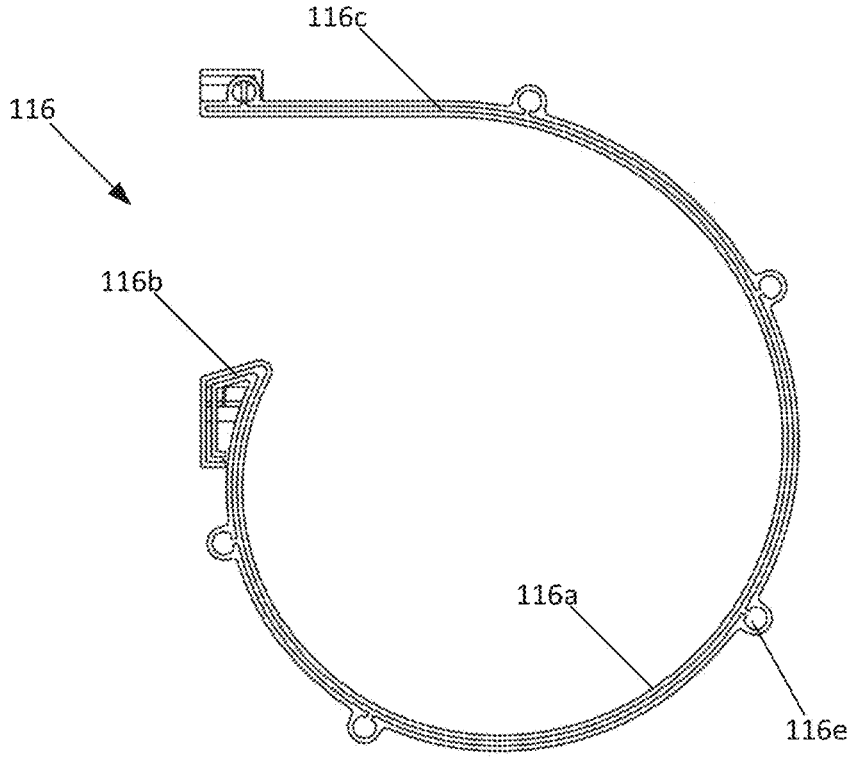
FIG. 13 is a schematic side view of the volute wall shown in FIG. 12.

As most easily viewed at FIGS. 12-13, the volute wall structure 116 can be a unitarily formed component, for example a polymeric molded component. In the example shown, the volute wall structure 116 defines a central curved portion 116*a* extending between a tongue portion 116*b* and an extension portion 116*c*. The central curved portion 116*a* and extension portion 116*c* are provided with a plurality of openings or bores 116*e*, extending the width of the volute wall structure, for receiving fasteners such that the first and second sidewalls 108, 110, via aligned corresponding openings, can be secured to the volute wall structure 118 with mechanical fasteners, such as screws or bolts. In some examples, the sidewalls 108, 110 are formed or provided with protrusions that extend into the openings 116*e* rather than using separate fasteners. Other securement methods may be utilized. The extension portion 116*c* is further provided with openings 116*f*, orthogonal to openings 116*e*, for receiving fasteners through openings in the perimeter wall structure 106. Similarly, the tongue portion 116*b* is also provided with openings 116*d*, orthogonal to openings 116*e*, for receiving fasteners through openings in the perimeter wall structure 106. With such a configuration, the inclusion of the volute wall structure 116 can significantly enhance the structural integrity of the housing assembly 104. In the example shown, the central curved portion 116*a* defines a continuously curved inner surface. In some examples, the inner surface has a varying radius of curvature. In some examples, the portion 116*a* can be formed of multiple straight segments approximating a curve, in which case the portion 116*b* may be referred to as a central portion 116*a* and/or guide portion 116*a*. In the example shown, the tongue portion 116*b* and extension portion 116*c* define generally planar surfaces. In the example shown, the surfaces defined by the tongue portion 116*b* and extension portion 116*c* are disposed in a non-parallel relationship with the surfaces diverging from each other in a direction towards their distal ends proximate the opening 106*a*. In some examples, the surfaces may be parallel to each other. As most easily seen at FIGS. 7-9, the tongue portion 116*b* adjoins the perimeter sidewall structure 106 on one side of the opening 106*a* while the extension portion 116*c* adjoins the perimeter sidewall structure 106 on the opposite side of the opening 106*b*.

Figure 14:
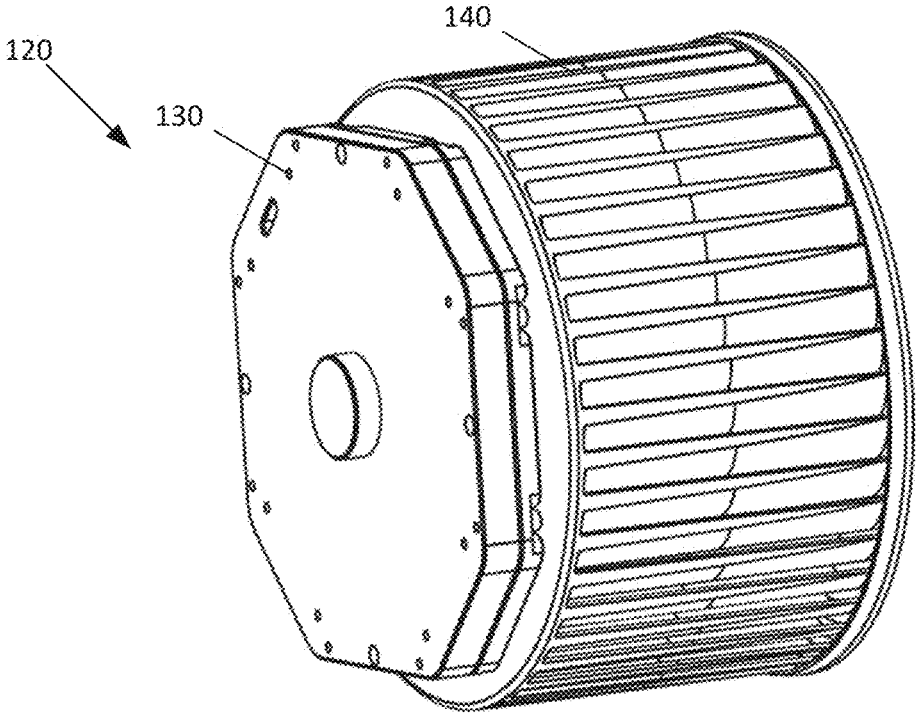
FIG. 14 is a schematic perspective view of a fan-motor assembly of the exhaust fan assembly shown in FIG. 1.
Figure 15:
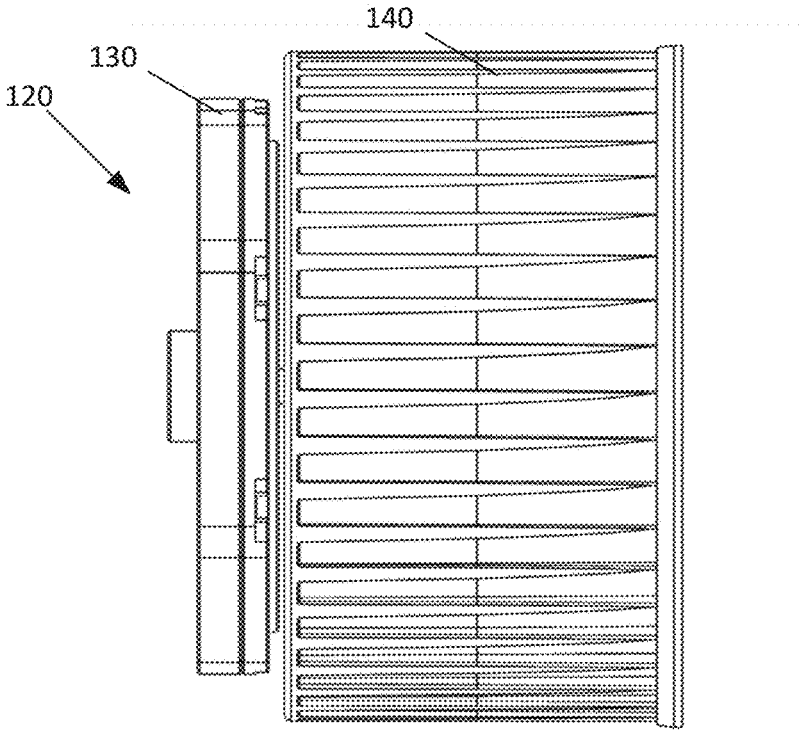
FIG. 15 is a schematic side view of the fan-motor assembly shown in FIG. 14.
Figure 16:
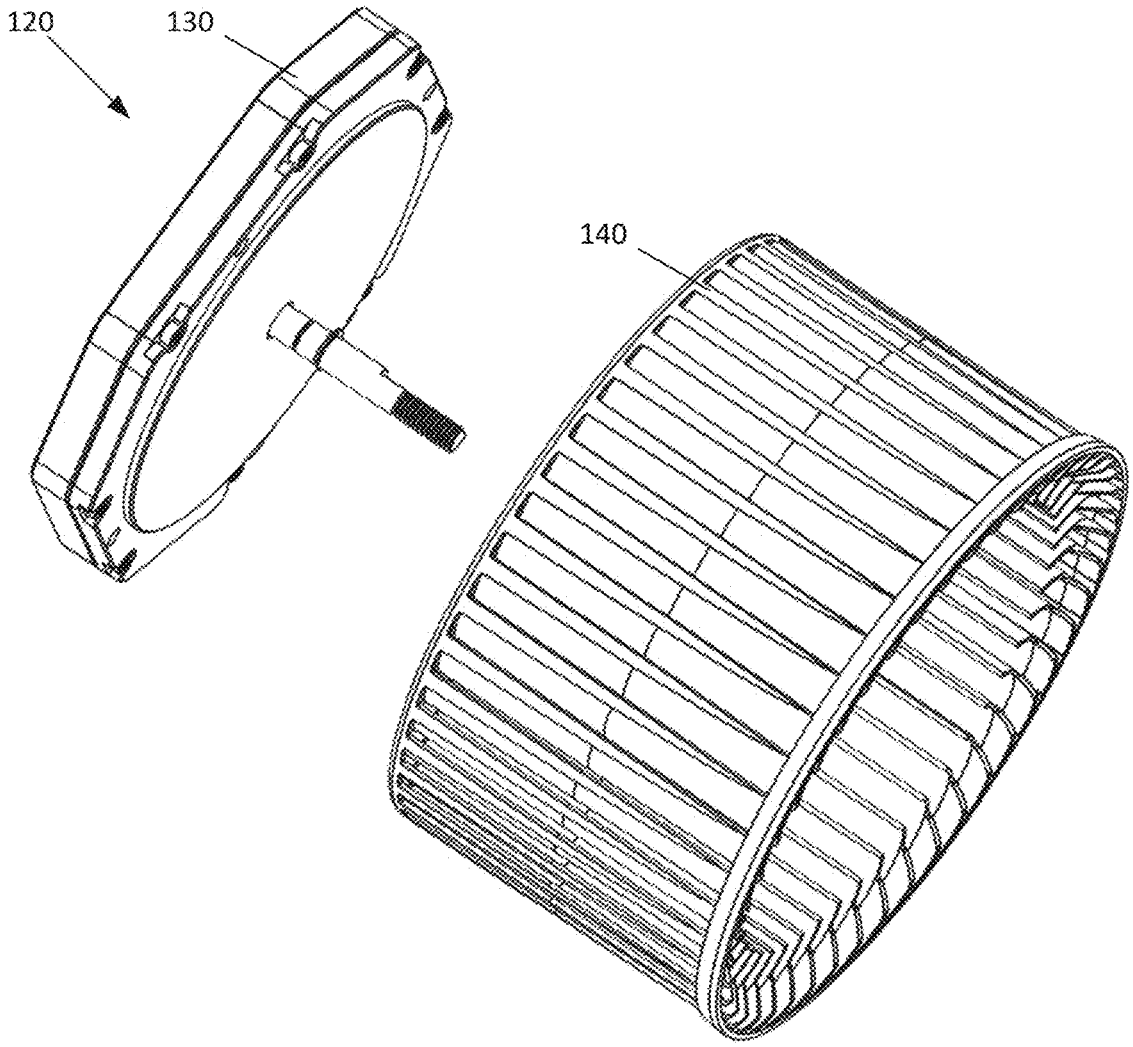
FIG. 16 is a schematic exploded perspective view of the fan-motor assembly shown in FIG. 14.
Figure 17:
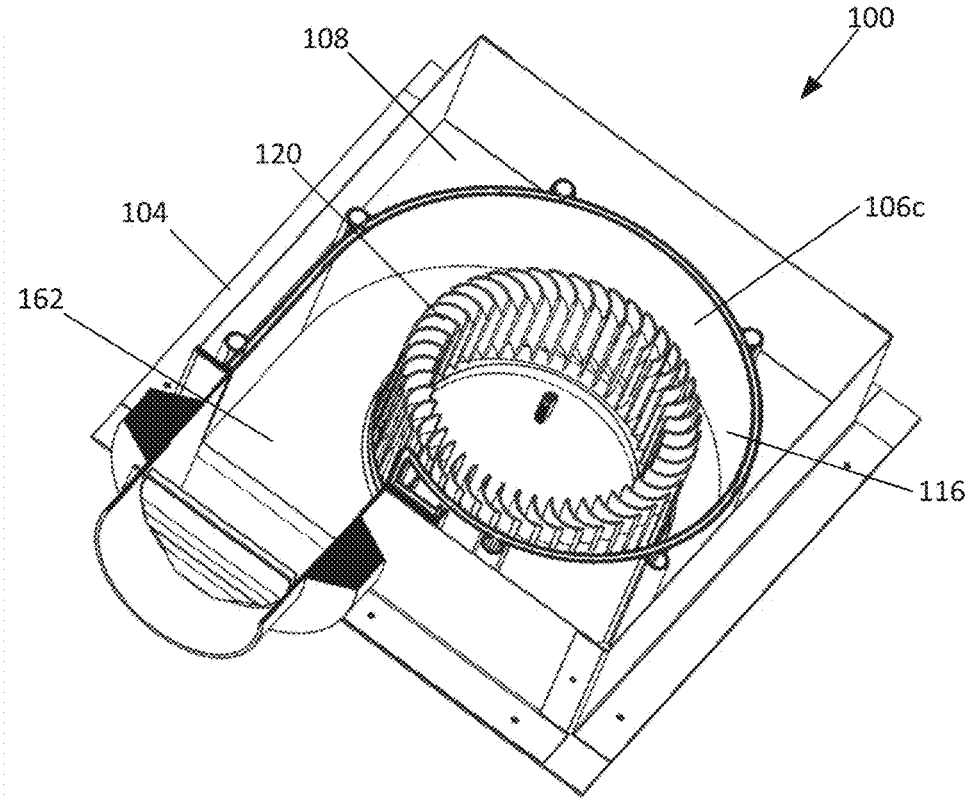
FIG. 17 is a perspective first side cross-sectional view of the fan-motor assembly shown in FIG. 1, with the addition of sound attenuation layers.
Figure 18:
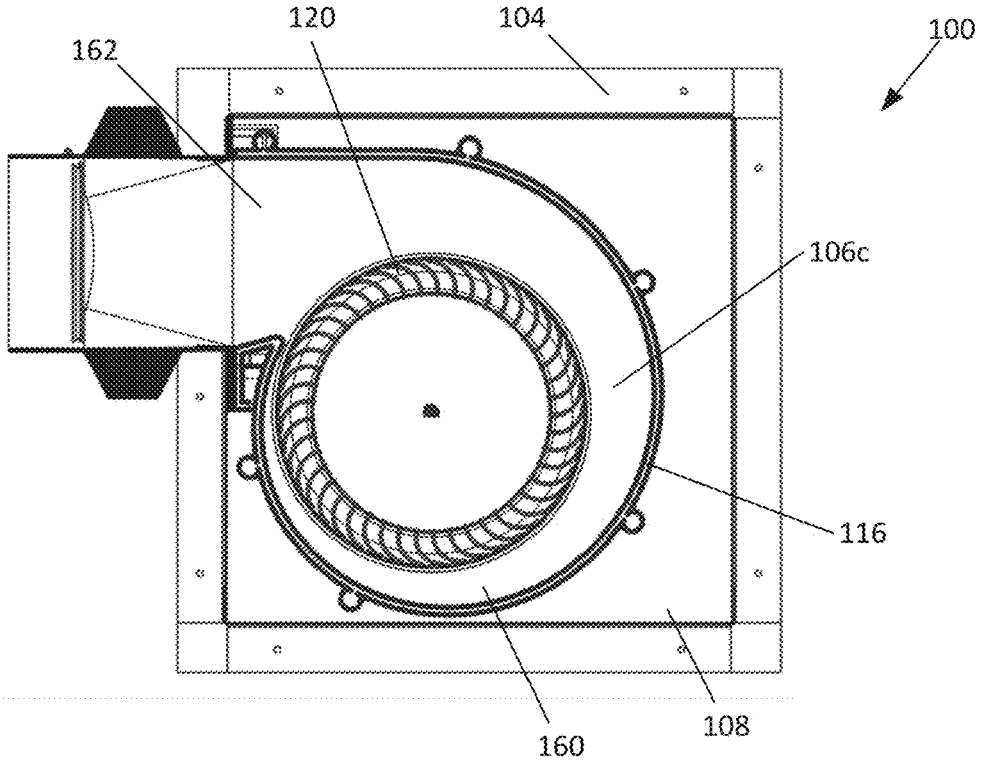
FIG. 18 is a first side cross-sectional view of the fan-motor assembly shown in FIG. 17.
Figure 19:
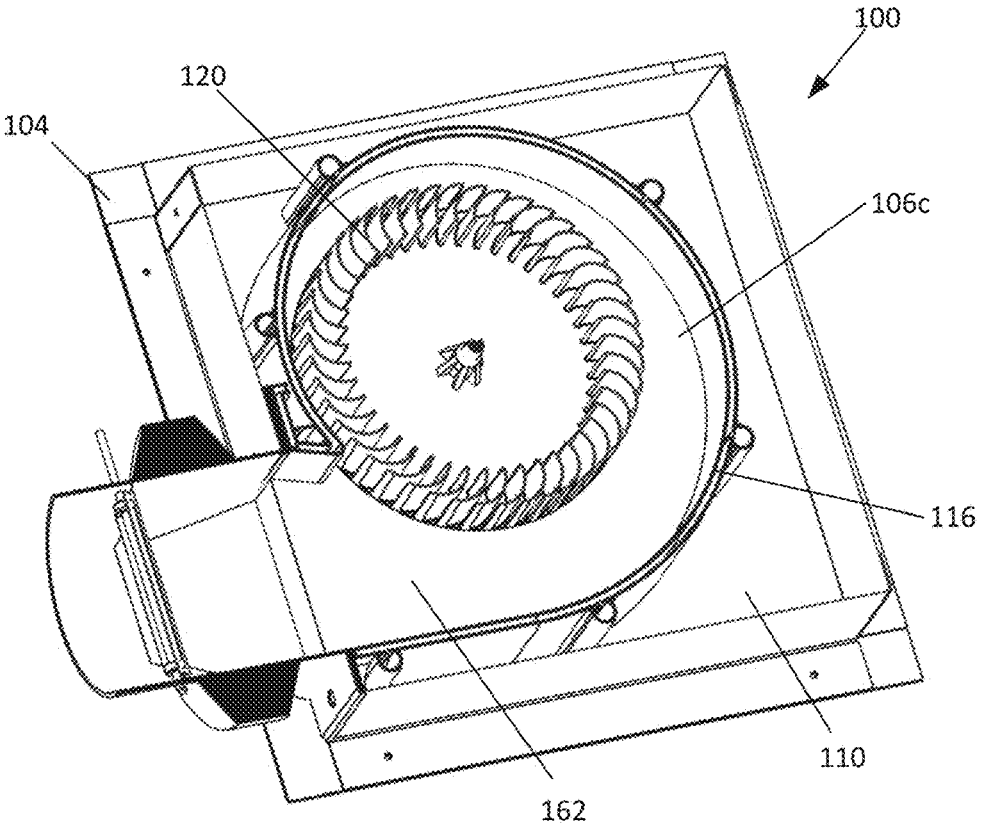
FIG. 19 is a perspective second side cross-sectional view of the fan-motor assembly shown in FIG. 17.
Figure 20:
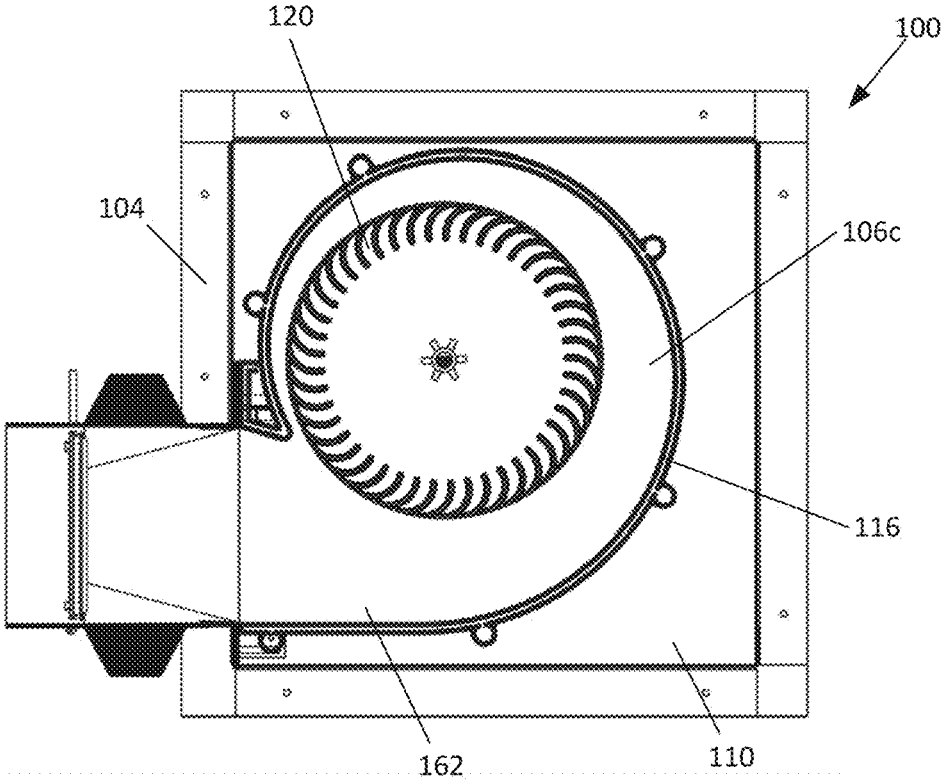
FIG. 20 is a second side cross-sectional view of the fan-motor assembly shown in FIG. 17.
Figure 21:
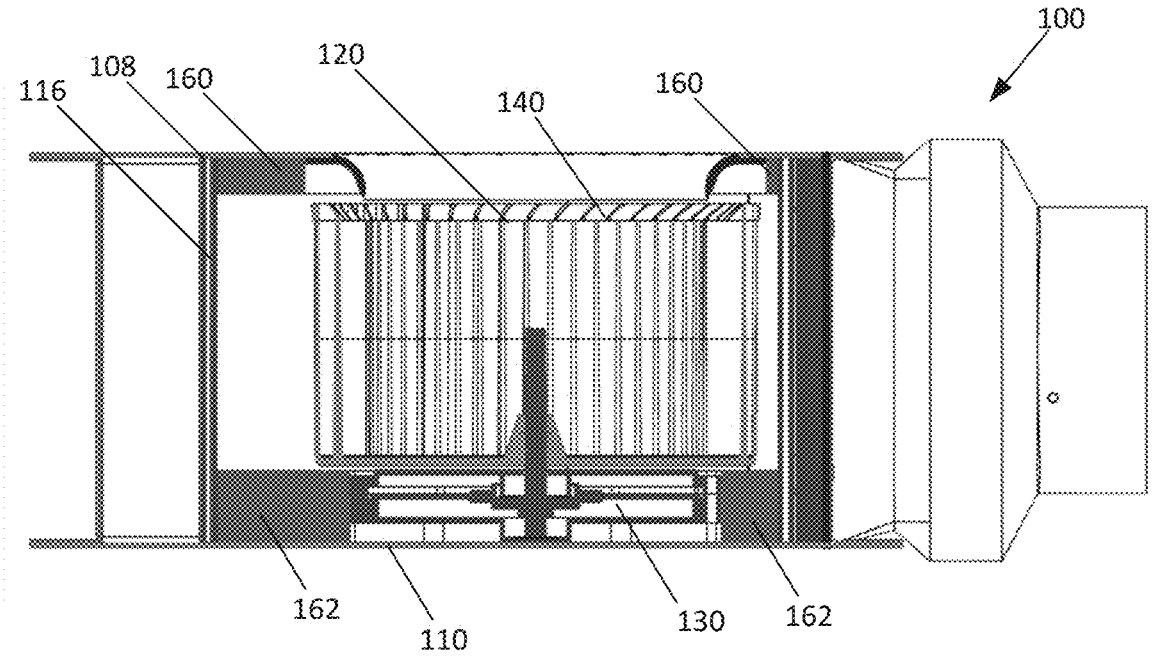
FIG. 21 is a first end cross-sectional view of the fan-motor assembly shown in FIG. 17.
Figure 22:
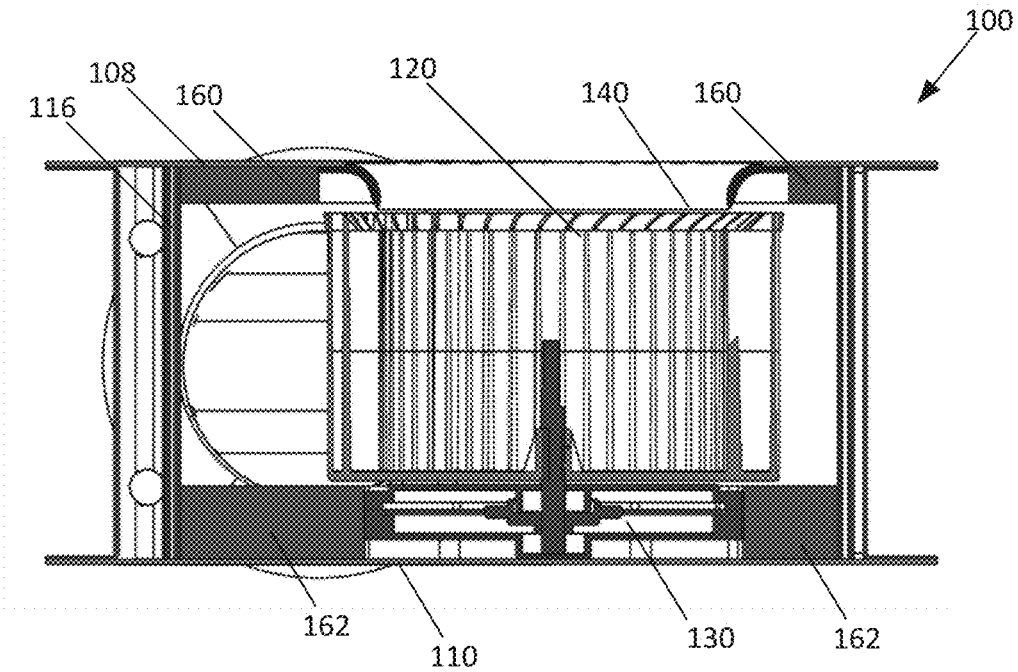
FIG. 22 is a second end cross-sectional view of the fan-motor assembly shown in FIG. 17.

In one aspect, and as shown in isolation at FIGS. 14-16, the exhaust fan assembly 100 includes a fan-motor assembly 120. In one aspect, the fan-motor assembly 120 includes an electric motor 130 and a fan wheel 140 operably coupled to the electric motor 130. In one aspect, the fan wheel 140 extends along a longitudinal axis X along a length L1, and is configured as a centrifugal fan wheel. Other fan wheel configurations are possible, such as mixed flow fan wheels. In one aspect, the fan wheel 140 includes a plurality of fan blades 142 extending between a base structure 144 and an annular inlet structure 146. The base structure 144 is shown as including a central opening 144*a* that receives a shaft 138 of the electric motor 130. In one aspect, the fan blades 142 define an inner inlet region 142*a* extending from the base structure 144 and the inlet structure 146. In one aspect, the inner inlet region 142*a* can be characterized as extending between a first plane P1, extending orthogonal to the longitudinal axis X and along the base structure 144, and a second plane P2, extending orthogonal to the longitudinal axis X and along the inlet structure 146.

In one aspect, the electric motor assembly 130 includes a housing 132 extending along the longitudinal axis X and having an axial length L2. In one aspect, the electric motor assembly 130 includes a stator assembly 134 and a rotor assembly 136 supported by the housing 132. When the electric motor assembly 130 is energized, the stator assembly 134 causes the rotor assembly 136 and a connected shaft 138 to rotate. In some examples, the base structure 144 can be connected directly to the rotor assembly 136 such that the shaft 138 can be omitted. In the example shown, the electric motor assembly 130 is configured as an axial flux motor, which may also be referred to as an axial gap motor or pancake motor, in which an axially extending gap between the rotor and stator extends in a direction parallel with the axis of rotation of the rotor assembly such that the flux generated by the motor also extends parallel to the axis of rotation. By using such a motor, the axial length L2 is significantly less than the axial length L1 of the fan wheel 110. As shown, the axial length L2 is less than half of the length L1 of the fan wheel 140, and in particular, is less than a third of the length L1. Other configurations are possible.

In one aspect, the fan-motor assembly 120 is mounted within the first interior region 106*c* of the housing assembly 104. In the example shown, the electric motor assembly housing 132 is mounted to the sidewall 110 with a plurality of fasteners and such that the electric motor assembly housing 132, including the stator assembly 134 and the rotor assembly 136, is located entirely between the sidewall 110 and the base structure 144. In one characterization, the stator assembly 134 and rotor assembly 136 can be said to be axially separated from and/or non-overlapping with the plurality of fan blades 142 in a direction along the longitudinal axis X. With such a configuration, and in contrast to conventional ceiling or wall exhaust fans, no part of the motor assembly housing 132 is located within the inner inlet region 142*a* defined by the fan blades 142. As the incoming airflow into the inner inlet region 142*a* is unobstructed by the motor housing 132, significant improvements in efficiency and performance, including a reduction in noise generation, can be realized.

Referring to FIGS. 17-22, it is illustrated that the fan assembly 100 can be additionally provided with internal sound attenuation layers 160, 162 adjacent the sidewalls 108, 110 and within the interior region 106*c* defined by the volute wall structure 116. In one aspect, the layers circumscribe the fan assembly 120. In some examples, the layers 160, 162 can be secured to the volute wall structure 116 and/or the sidewalls 108, 110 with an adhesive. The layers 160, 162 can be formed from any variety of materials and configurations, such as solid or perforated foam materials, that have sound absorption properties. In the example shown, the sound attenuation layers 160, 162 have different thicknesses where layer 162 is provided with a greater thickness in comparison to layer 160, such that the outside perimeter of the electric motor 130 is circumscribed by the layer 162. The layers 160, 162 can also be provided with the same thickness. In some examples, one or both of the layers 160, 162 has a thickness of about a half inch. The layers 160, 162 also function to narrow the air passageway to a width that generally corresponds to the width of the fan wheel 140 which improves the operating efficiency of the fan assembly 100. In one aspect, the airflow passageway between the downflow side of the fan wheel 140 and the outlet opening 106*b* is defined by the layers 160, 162 and the volute wall structure 116.

Figure 23:
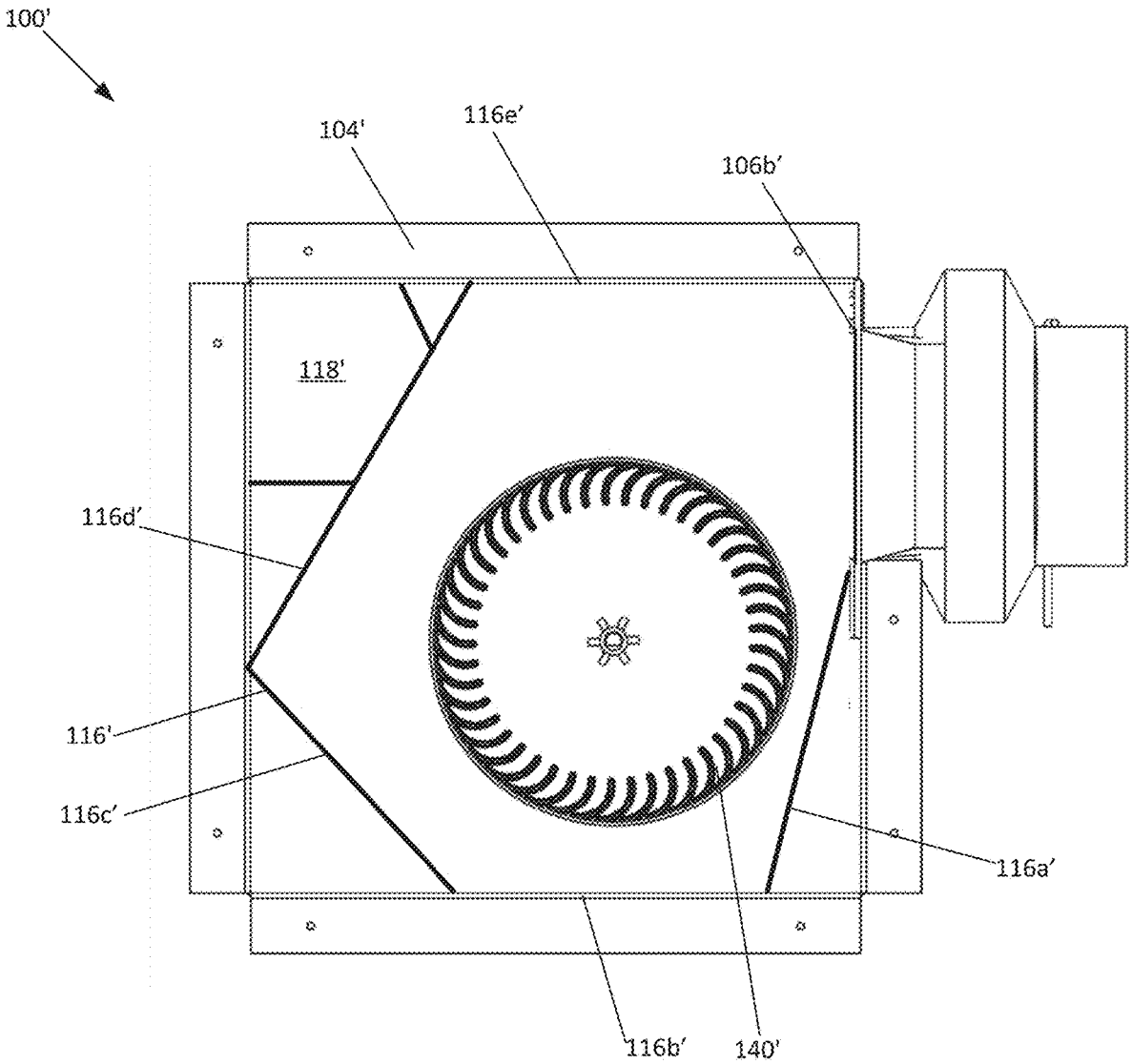
FIG. 23 is a first side view of an alternative fan assembly arrangement.

Referring to FIG. 23, an alternative fan assembly 100' is schematically shown with a differently configured volute wall structure 116'. In one aspect, the example shown at FIG. 23 illustrates that the volute wall structure can be formed by multiple segments of straight lines as opposed to a continuously curved profile. As such, FIG. 23 demonstrates that the volute wall structure 116 of FIGS. 1-22 can be similarly provided with a non-curved surface and instead with multiple linear segments approximating a curved surface. FIG. 23 further illustrates that the sidewalls of the housing 104' can form part of the volute wall structure 116'. As shown, the volute wall structure 116' is provided with segments 116*a*' to 116*e*' in which the segments 116*b*' and 116*e*' are defined by the sidewalls of the housing 104'. Segment 116*a*' is provided as a separate sidewall section extending generally from the air outlet opening 106*b*' to the housing sidewall portion defining segment 116*b*'. Segment 116*c*' is similarly provided as a separate sidewall section extending from the housing sidewall portion defining segment 116*b*' to the adjacent housing sidewall. Segment 116*d*' is shown as being at least partially defined by the junction box 118' which is disposed at an oblique angle to the adjacent housing sidewalls and at least partially defined by either the housing sidewall or a separate wall section. With such an arrangement, a volute is approximated by a series of wall sections 116*a*' to 116*e*' that form an obtuse angle with each other to guide the airflow from the outlet side of the fan wheel 140' to the outlet opening 106*b*'. Although this configuration is not as efficient as the example illustrated at FIGS. 1-22, the configuration still provides for a generally acceptable operating efficiency range significantly reducing costs in comparison to exhaust fan assemblies having a separate and wholly defined volute. Other configurations are also possible. For example, rather than sections 116*c*' and 116*d*' extending to join at a corner, as shown, each segment could extend to the housing sidewall and be separated by a distance such that portions of that sidewall also form a portion of the volute wall structure 116'. More or fewer wall sections may also be provided.

In some examples, the fan assembly 100' has an air flow capacity of up to 400 cubic feet per minute (cfm), for example an air flow capacity of between 50 cfm and 150 cfm.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. An exhaust fan assembly comprising:

a) a housing assembly including:

i) a perimeter wall structure defining an interior region and an air outlet opening;

ii) a first sidewall mounted to a first side of the perimeter wall structure and defining an air inlet opening; and iii) a second sidewall mounted to a second side of the perimeter wall structure;

b) a volute wall structure extending between the first and second sidewalls and dividing the interior region into a first interior region and a second interior region, the first interior region defined by the volute wall structure, the first sidewall, and the second sidewall, and being in fluid communication with the air inlet opening and the air outlet opening;

c) an electrical box disposed within the second interior region;

d) a fan wheel disposed within the first interior region, the fan wheel having a plurality of fan blades rotatable about a longitudinal axis; and e) an electric motor disposed within the first interior region and operably coupled to the fan wheel, wherein a stator and a rotor of the electric motor are axially separated from the plurality of fan blades in a direction along the longitudinal axis.

2. The exhaust fan assembly of claim 1, wherein the volute wall structure is formed from a polymeric material, and wherein the housing assembly is formed from a metal material.

3. The exhaust fan assembly of claim 2, wherein a length of a portion of the electric motor including the stator and the rotor is less than half of a length of the plurality of fan blades.

4. The exhaust fan assembly of claim 3, wherein the stator and rotor of the electric motor are located entirely between a generally planar base structure of the fan wheel and the second sidewall.

5. The exhaust fan assembly of claim 1, wherein the electric motor is an axial flux type motor.

6. The exhaust fan assembly of claim 1, wherein the fan wheel is a centrifugal fan wheel.

7. The exhaust fan assembly of claim 1, wherein the volute wall structure is mounted to one or more of the perimeter wall structure, the first sidewall, and the second sidewall.

8. The exhaust fan assembly of claim 1, wherein the volute wall structure defines a tongue portion adjacent the air outlet opening in the perimeter wall structure.

9. The exhaust fan assembly of claim 8, wherein the volute wall structure defines a curved portion extending to the tongue portion.

10. The exhaust fan assembly of claim 9, wherein the curved portion is a continuously curved portion.

11. The exhaust fan assembly of claim 10, wherein the curved portion has a varying radius of curvature.

12. The exhaust fan assembly of claim 9, wherein the volute wall structure defines an extension portion extending between the curved portion and the air outlet opening on a side opposite the tongue portion.

13. The exhaust fan assembly of claim 1, wherein the perimeter wall structure has a height of no greater than 7⅜ inches.

14. The exhaust fan assembly of claim 1, further including one or both of a first sound attenuation layer disposed adjacent the first sidewall and within the first interior region and a second sound attenuation layer disposed adjacent the second sidewall and within the first interior region.

15. The exhaust fan assembly of claim 1, wherein the perimeter wall structure has a height of no greater than 4 inches.

16. The exhaust fan assembly of claim 1, further including a grill mounted to the housing assembly.

17. An exhaust fan assembly comprising:

a) a housing assembly defining an interior region extending between an air inlet opening and an air outlet opening, wherein the housing assembly includes a perimeter wall structure defining the interior region and the air outlet opening, a first sidewall mounted to a first side of the perimeter wall structure and defining the air inlet opening, and a second sidewall mounted to a second side of the perimeter wall structure;

b) a fan wheel disposed within interior region, the fan wheel including a plurality of fan blades defining an inner inlet region;

c) an electric motor disposed within the interior region and operably coupled to the fan wheel, the electric motor being mounted to the housing assembly such that a stator and a rotor of the electric motor are located entirely outside of the inner inlet region; and d) a volute wall structure extending between the first and second sidewalls and dividing the interior region into a first interior region and a second interior region, the first interior region being in fluid communication with the air inlet opening and the air outlet opening, wherein the fan wheel and the electric motor are located within the first interior region.

18. The exhaust fan assembly of claim 17, wherein the electric motor is located entirely between the fan wheel and the second sidewall.

* * * * *